US010118429B2

(12) United States Patent
Park et al.

(10) Patent No.: US 10,118,429 B2
(45) Date of Patent: Nov. 6, 2018

(54) INTERACTIVE BOOK

(71) Applicants: Ronald Park, West Calder (GB); Catrina Park, West Calder (GB)

(72) Inventors: Ronald Park, West Calder (GB); Catrina Park, West Calder (GB)

( * ) Notice: Subject to any disclaimer, the term of this patent is extended or adjusted under 35 U.S.C. 154(b) by 0 days.

(21) Appl. No.: 15/562,268

(22) PCT Filed: Mar. 31, 2016

(86) PCT No.: PCT/GB2016/050917

§ 371 (c)(1),
(2) Date: Sep. 27, 2017

(87) PCT Pub. No.: WO2016/156859

PCT Pub. Date: Oct. 6, 2016

(65) Prior Publication Data

US 2018/0086129 A1 Mar. 29, 2018

(30) Foreign Application Priority Data

Apr. 1, 2015 (GB) ..... 1505646.8
Oct. 21, 2015 (GB) ..... 1518614.1

(51) Int. Cl.

| | |
|---|---|
| ***B42D 1/00*** | (2006.01) |
| ***B65D 50/04*** | (2006.01) |
| ***B65D 41/04*** | (2006.01) |
| ***B42D 3/12*** | (2006.01) |

(Continued)

(52) U.S. Cl.

CPC ..... *B42D 1/004* (2013.01); *A63H 33/38* (2013.01); *B42D 1/007* (2013.01); *B42D 1/008* (2013.01); *B42D 3/12* (2013.01); *B42D 3/18* (2013.01); *B65D 41/04* (2013.01); *B65D 50/04* (2013.01); *B65D 50/046* (2013.01)

(58) Field of Classification Search

CPC ..... B42D 1/00; B65D 41/04; B65D 50/04; B65D 50/046

USPC ..... 281/15.1, 51; 206/472, 474; 220/288, 220/298, 300, 630, 634

See application file for complete search history.

(56) References Cited

U.S. PATENT DOCUMENTS 1,434,322 A * 10/1922 Wigzell ..... F01P 11/0214 220/300
1,527,248 A * 2/1925 Bowers ..... B42D 1/004 281/31

(Continued)

FOREIGN PATENT DOCUMENTS

AU 2006100888 A4 * 11/2006 ..... B42D 1/004
WO WO-9412257 A1 * 6/1994 ..... A63H 33/38

OTHER PUBLICATIONS

Achermann, Didier, "International Search Report," prepared for PCT/GB2016/050917, dated Jun. 3, 2016, three pages.

*Primary Examiner* — Kyle R Grabowski
(74) *Attorney, Agent, or Firm* — Winstead PC

(57) ABSTRACT

A book is provided which comprises front and back covers (12,14) and a plurality of pages (16) bound between the covers. A plurality of the pages (16) each have an aperture (18) and the resulting plurality of apertures cooperate with the back cover (14) to define a recess (22) extending through the pages. The book further comprises a container (24) attached to the back cover (14) so as to be located in the recess (22). The book may have multiple recesses and associated containers.

15 Claims, 9 Drawing Sheets

(51) Int. Cl.
*A63H 33/38* (2006.01)
*B42D 3/18* (2006.01)

(56) References Cited

U.S. PATENT DOCUMENTS 2,874,707 A * 2/1959 Koppel ..... A45D 29/20
206/472
3,715,075 A * 2/1973 Blau ..... B65D 39/08
220/288
4,365,438 A * 12/1982 Nelson ..... A63H 33/38
206/472
4,809,869 A * 3/1989 Cosgrove ..... B60K 15/0406
220/288

* cited by examiner

INTERACTIVE BOOK

FIELD OF THE INVENTION

The present invention relates to the field of books. More specifically, the present invention provides a book which includes a container in which a variety of items may be stored and accessed.

BACKGROUND OF THE INVENTION

A number of types of "interactive" books are known, in which the books include additional features which involve the reader and go beyond the simple reading of words and pictures on a page. The term "interactive" does not simply apply to books having digital or electronic elements, but equally applies to having additional non-electronic elements such as, for example, pop-up books, hidden object books where words and/or pictures are hidden behind flaps, and touch and feel books having different materials and surfaces for the reader to investigate. A large number of these interactive books are directed at young children and intended to encourage, amongst other things, exploration and investigation, basic reading skills, and tactility.

Whilst the aforementioned types of interactive book aid a young child's development this could be further improved by the introduction of other objects in conjunction with the book being read. For example, a book may be enhanced and of additional interest to the reader if objects relating to the content of the book are provided along with the book itself. For example, if the book tells a story then figures of the story characters provided along with the book may increase further the interest of the child in the book. If the book is for more educational purposes, it may be beneficial to include objects relating to the topic such as, for example, if learning about different food groups it may further the reader's development and understanding of the topic if replica, or indeed real, food items are included.

Whilst the provision of the additional objects would enhance the reader's experience and development one needs to be able to store such additional items for when the book is to be read. It is therefore an aim of the present invention to provide a book which includes a container for storing such items.

SUMMARY OF THE INVENTION

According to a first aspect of the invention there is provided a book comprising front and back covers and a plurality of pages bound between the covers, wherein a plurality of the pages each have an aperture and the resulting plurality of apertures cooperate with the back cover to define a recess extending through the pages, and wherein the book further comprises a container attached to the back cover so as to be located in the recess.

The term "bound" should be understood to mean that the covers and pages may be sewn or glued together, or attached in any other manner used in a book production process.

Alternatively, all of the pages of the book may have an aperture such that the recess extends through the book. The front cover may also include an aperture which defines the recess along with the apertures in the pages, such that the container is accessible when the book is closed.

The front cover or uppermost page of the book which has an aperture may include a flap which covers the aperture. Thus, the flap can give selective access to the container within the recess.

The container may extend through a plane of the front cover. Alternatively, the container may be substantially flush with a plane of the front cover.

The container may include one or more divider members which divide the interior of the container into two or more compartments.

The container may comprise a body and a lid. The container may further comprise a locking mechanism for locking the lid in a closed position.

The locking mechanism may comprise at least one actuator slidably attached to one of the lid and body, at least one locking recess on the other of the lid and body for receiving at least a portion of the at least one actuator, and an actuator biasing member which biases the at least one actuator towards the at least one locking recess.

The locking mechanism may further comprise a locking member which can be selectively moved between locked and unlocked positions, wherein in the locked position the locking member prevents movement of the at least one actuator against the force of the actuator biasing member. As such, when a portion of the locking member is located in the locking recess it cannot be removed from the locking recess when the locking member is in the locked position.

The locking mechanism may comprise a pair of actuators slidably attached to the lid and a pair of locking recesses on the body, wherein the actuator biasing member is located between the pair of actuators so as to bias the actuators in substantially opposite directions towards their respective locking recesses.

The locking mechanism may further comprise a locking member which can be selectively moved between locked and unlocked positions, wherein in the locked position the locking member is located between the pair of actuators so as to prevent movement of both actuators against the force of the actuator biasing member.

In an alternative embodiment the container may comprise a body having an open end, a lid having an inner rim, and a seal member which is located adjacent the open end of the body so as to selectively engage the inner rim of the lid and close the container, wherein the seal member comprises first and second ridges which project radially outwards from the seal member, the first ridge is closer to the open end than the second ridge, and the second ridge projects a greater radial distance than the first ridge.

The container may be removably attached to the back cover. The back cover may include at least one attachment member which receives a portion of the container so as to selectively attach the container to the back cover. The at least one attachment member may be resilient so as to provide a snap fit with, or selectively clamp, the portion of the container to the back cover. Alternatively, the container may include a plurality of outwardly extending lugs, and the attachment member may include a corresponding plurality of L-shaped channels for receiving the lugs. In this way a bayonet-type fitting is provided between the container and the back cover.

The book may further comprise at least one container biasing member having a first end attached to the back cover so as to bias the container away from the back cover when the container is present. The book may further comprise a base plate for receiving a base of the container, wherein a second end of the at least one container biasing member is attached to the base plate so as to bias the base plate and container away from the back cover. The back cover and base plate may include hooks to which the first and second ends of the at least one container biasing member are attached.

According to a second aspect of the invention there is provided a book comprising front and back covers and a plurality of pages bound between the covers, wherein a plurality of the pages each have multiple apertures and the resulting multiple groups of apertures cooperate with the back cover to define respective multiple recesses extending through the pages, and wherein the book further comprises multiple containers attached to the back cover so as to be located in the corresponding multiple recesses.

BRIEF DESCRIPTION OF THE DRAWINGS

A preferred embodiment of the present invention will now be described, by way of example only, with reference to the following drawings where.

DETAILED DESCRIPTION OF THE DRAWINGS

Figure 1:
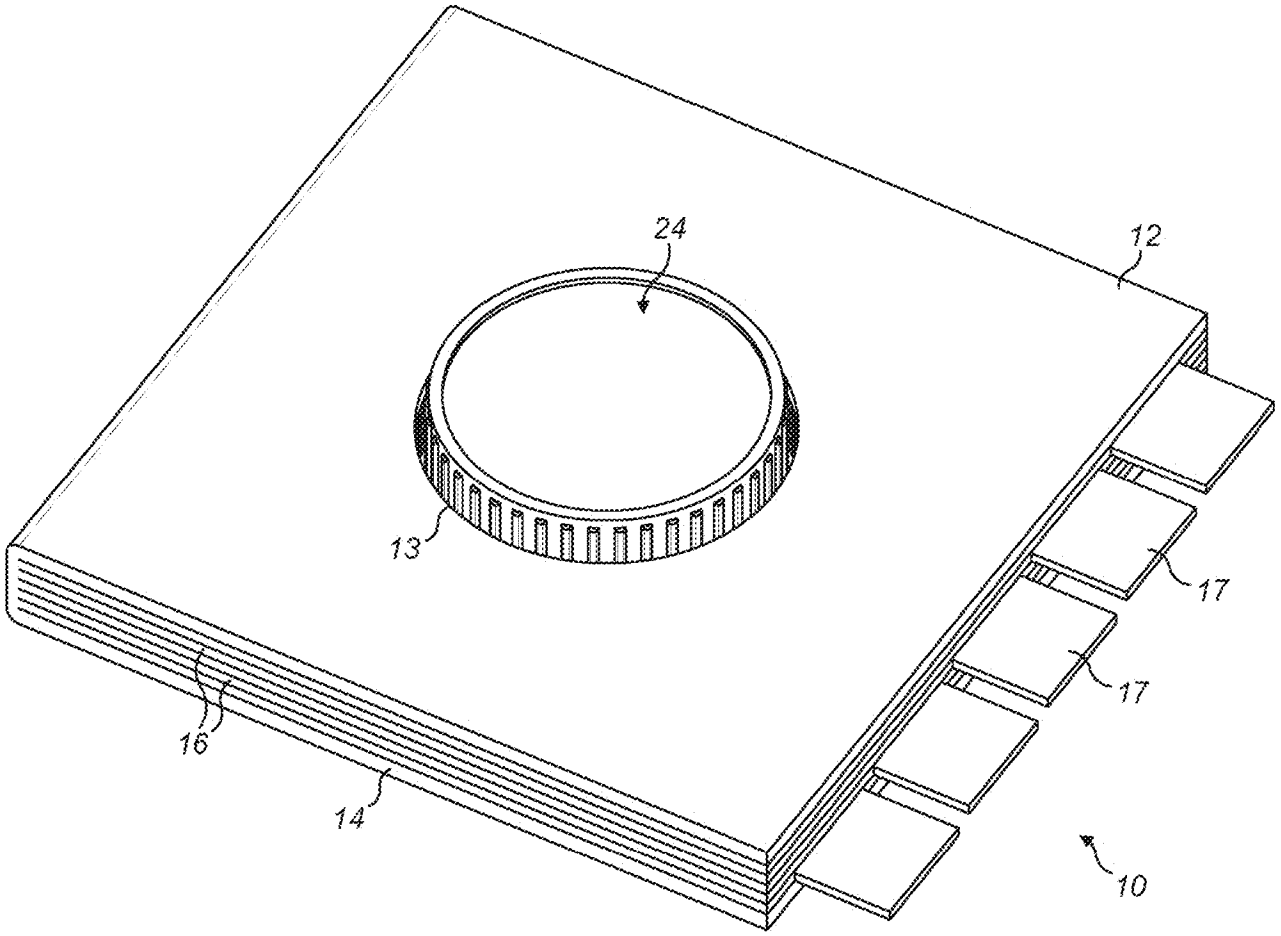
FIG. 1 is a perspective view of a first embodiment of an interactive book.

A book, generally designated 10, is shown in FIG. 1 and comprises a front cover 12, a back cover 14, and a plurality of pages 16 bound between the covers 12,14. By "bound" it is meant that the covers 12,14 and pages 16 are sewn or glued together, or otherwise attached in a manner well known in a book production process. The covers 12,14 and pages may be formed from water repellent materials so that they are easy to clean. The covers 12,14 and pages 16 are preferably formed from a resilient material, such as plastic or card. To assist young readers one or more of the pages 16 may include an outwardly extending tab 17 to allow the reader to turn the pages more easily. As more clearly shown in FIG. 2 a number of the pages 16 each have an aperture 18 cut therein at an identical location and when the book is closed the resulting plurality of apertures align and cooperate with an inside face 20 of the back cover 14 to define a recess 22 extending through the pages 16. Located in the recess 22 is a container 24 which is attached to the inside face 20 of the back cover 14. The book is intended to be interactive in the sense that it will give the reader an additional experience beyond simply reading the content on the pages. Thus the container 24 is intended to carry additional items or objects relating to the content of the book such as, for example, figures relating to the characters in a story, or sample foodstuffs relating to food groups described on the pages.

In the illustrated embodiment all of the pages 16 of the book 10 have an aperture 18 cut therein such that the recess 22 extends right through the book from the back cover 14 forwards. The front cover 12 also includes an aperture 13 which aligns with the apertures 18 in the pages 16 when the book is closed and also defines the recess 22 along with the apertures in the pages. As can be seen from FIG. 1 this means that the container 24 is accessible when the book 10 is closed, and also no matter how many of the pages of the book have been turned. The container 24 has a height greater than the thickness of the book 10 so that the container extends through, or above, the plane of the front cover 12. However, in an alternative embodiment the top of the container may be substantially flush with the plane of the front cover.

The container 24 may be fixed to the back cover 14, but in the illustrated embodiment the container is removable so that it may be cleaned, for example. This is particularly beneficial if the container 24 is intended to carry foodstuffs such as pieces of fruit or vegetables. In its removable figuration the container is preferably made from a plastics material which is known to withstand being placed in a microwave oven or dishwasher. Referring to FIGS. 2-5, the back cover 14 includes an attachment member 30 which is preferably formed from a moulded plastics material and receives a portion of the container 24 so as to selectively attach the container to the back cover. The attachment member 30 may be bonded to the back cover 14. The join between the back cover 14 and the attachment member 30 is sealed so that it is impervious to water and other liquids. The attachment member may be resilient so as to provide a snap fit with the portion of the container, but is instead preferably adapted to provide a bayonet-type fitting as best viewed in FIGS. 4 and 5. The container 24 includes a plurality of outwardly extending lugs 26, and the attachment member 30 includes a corresponding plurality of L-shaped channels 32 for receiving the lugs 26. Hence, in order to attach the container 24 to the book 10 the lugs 26 are aligned with the vertical portions of the L-shaped channels 32, the container is pressed downwards into the attachment member 30, and then the container is rotated so that the lugs 26 move substantially horizontally in the horizontal portions of the channels 32. The container 24 is thus attached to the back cover 14 of the book 10 and the process can be reversed in order to detach the container 24.

Figures 2, 3:
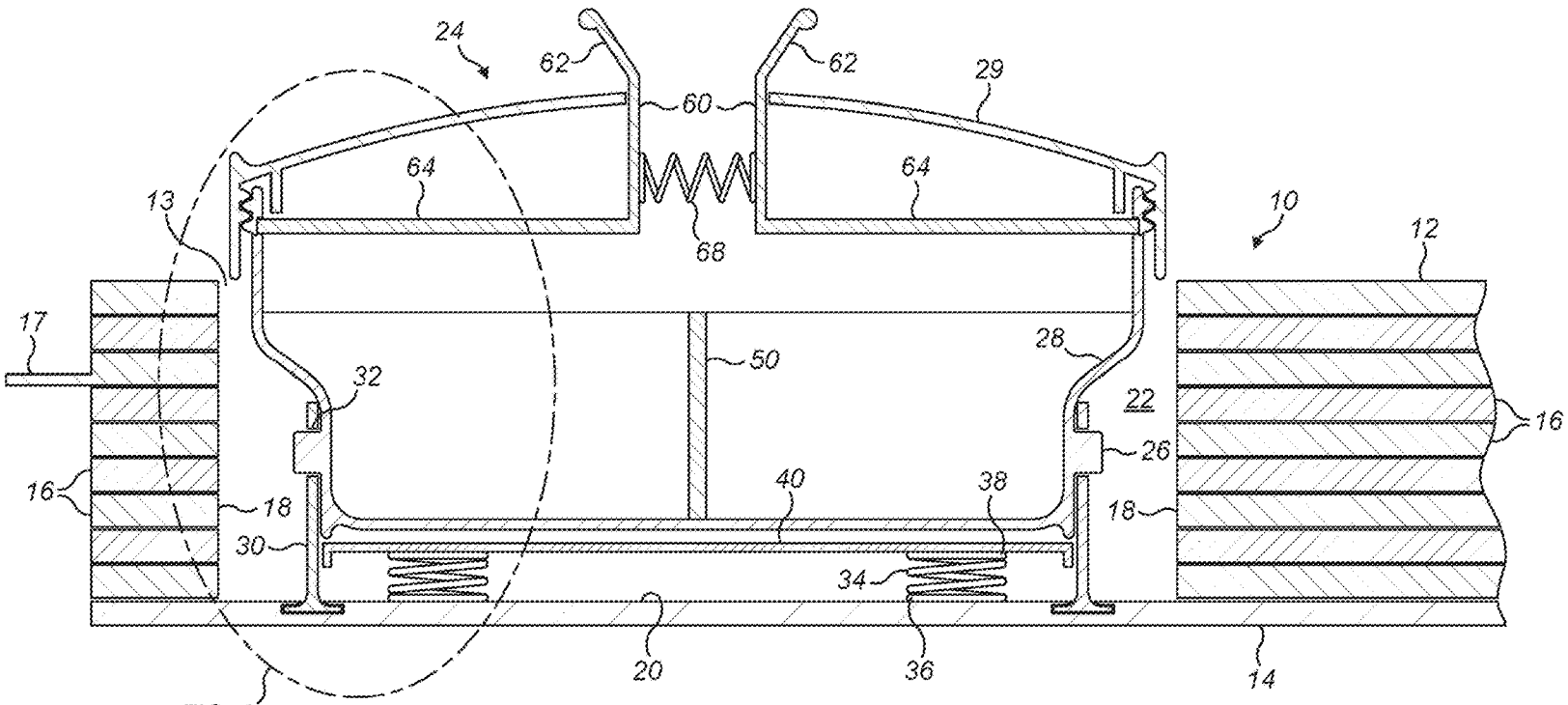
FIG. 2 is a sectional view of a portion of the book shown in FIG. 1.
FIG. 3 is a detail view of the area marked "III" in FIG. 2.
Figure 3:
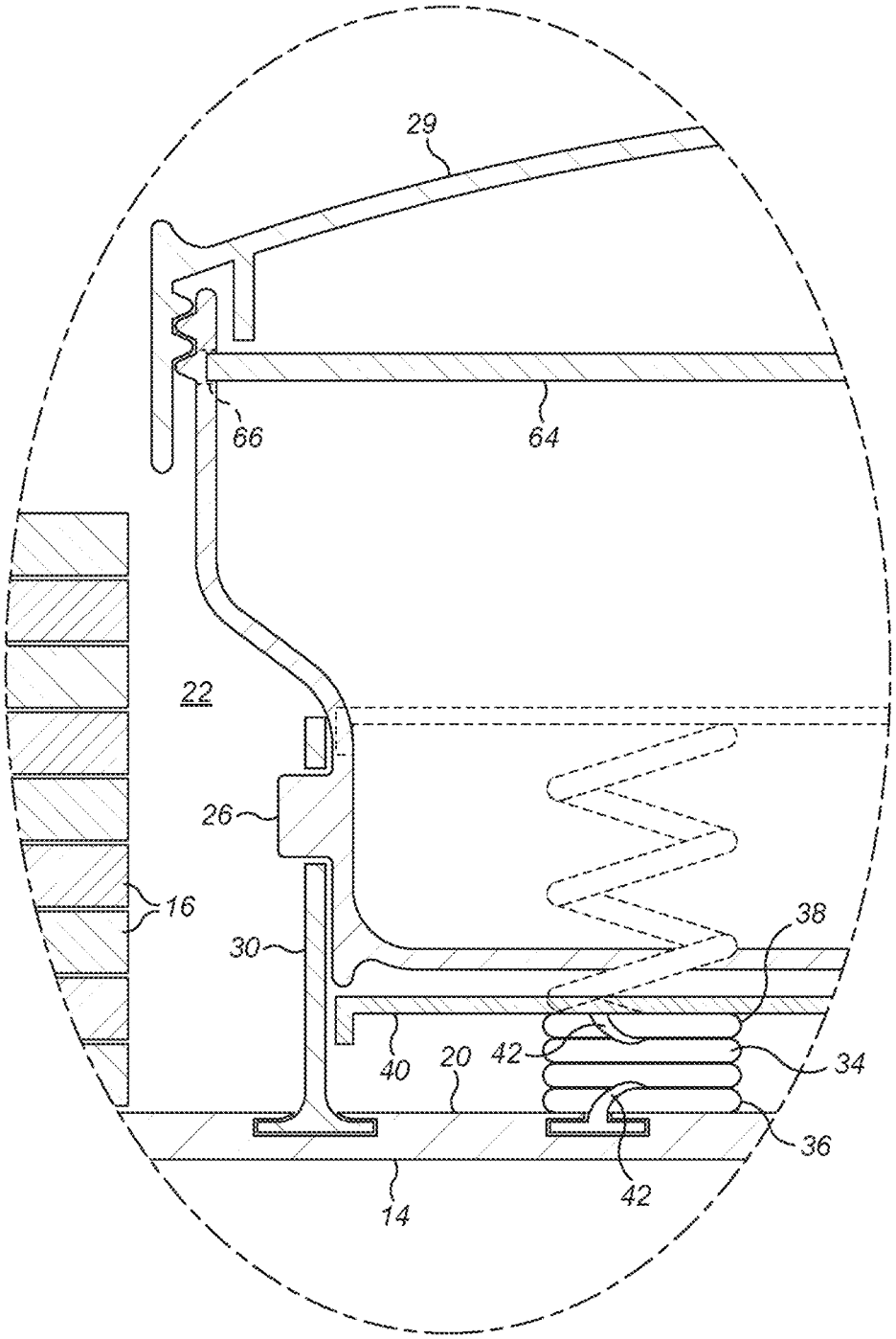
Figure 4:
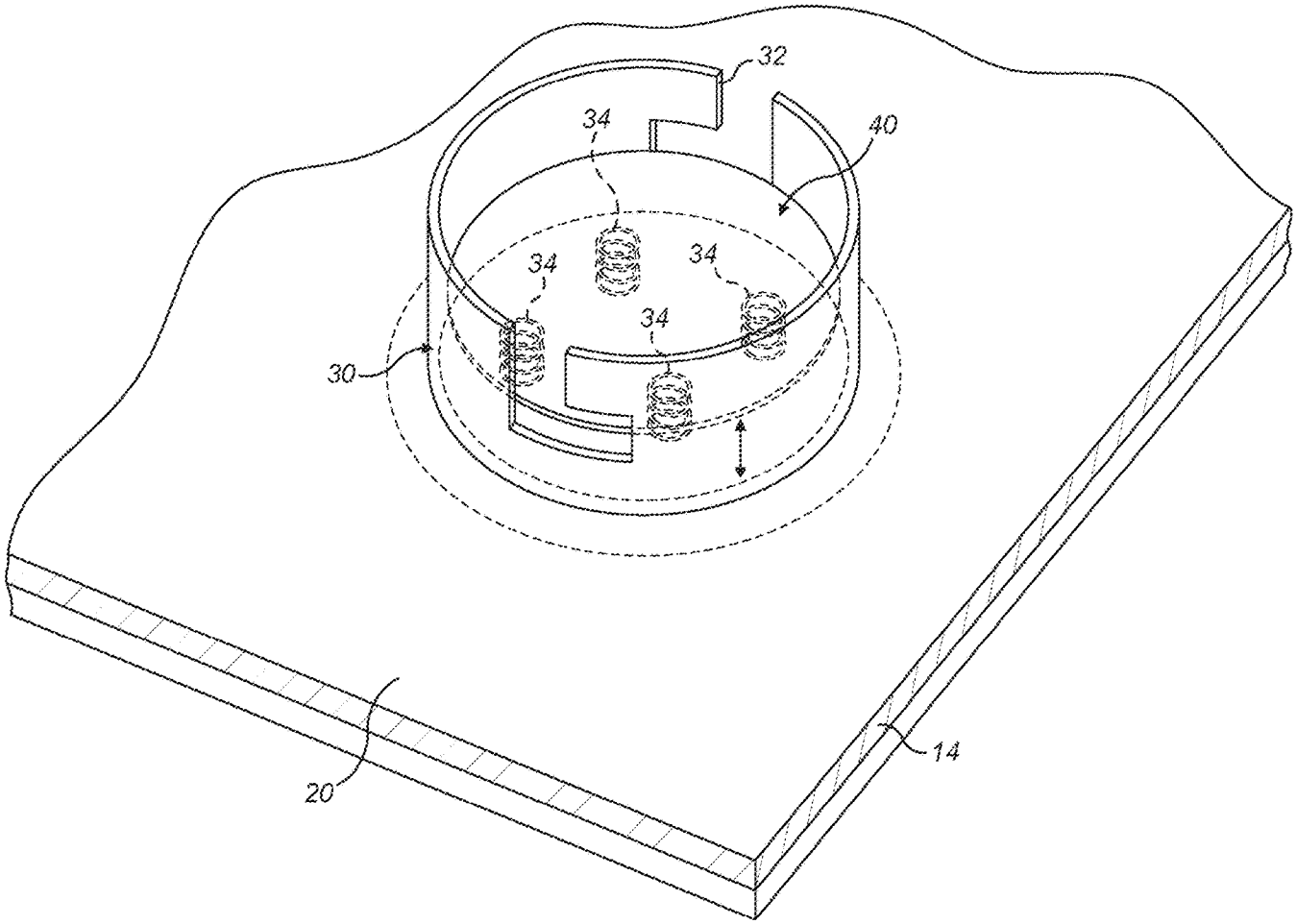
FIG. 4 is a perspective view of the inside of a back cover of the book of FIG. 1.

Referring to FIGS. 2 and 3, the book may further comprise at least one container biasing member, which is preferably a compression spring 34 but may alternatively be an elastomeric rod or other suitable biasing means. The compression spring 34 may be plastic-coated and/or formed from a corrosion-resistant material and has a first end 36 attached to the back cover 14 so as to bias the container 24 away from the back cover 14 when the container is present. This biasing means also helps to secure the container 24 in the bayonet fitting of the attachment member 30 due to the upward force applied to the container. The biasing means may act directly upon the container 24, but the attachment member 30 preferably includes a base plate 40 which sits within the attachment member for receiving the base of the container. A small gap (e.g. 1-3 mm) is provided between an internal wall of the attachment member 30 and the outside edge of the plate 40 so that the plate may move relative to the attachment member. A second end 38 of the compression spring 34 is attached to the base plate 40 so as to bias the base plate away from the back cover 14. As seen in FIG. 3, the back cover 14 and base plate 40 may each include hooks 42 to which the first and second ends 36,38 of the compression spring 34 are attached. There are preferably a plurality of compression springs 34 attached to the back cover 14, such as the four springs shown in FIG. 4.

The container 24 has a body 28 and a lid 29 which may be opened or indeed removed entirely from the body 28 in order to access the interior of the container. As seen in FIG. 2, the container 24 may optionally include one or more divider members 50 which divide the interior of the container into two or more distinct compartments. These divider members 50 may themselves be removable from the container 24.

Figure 5:
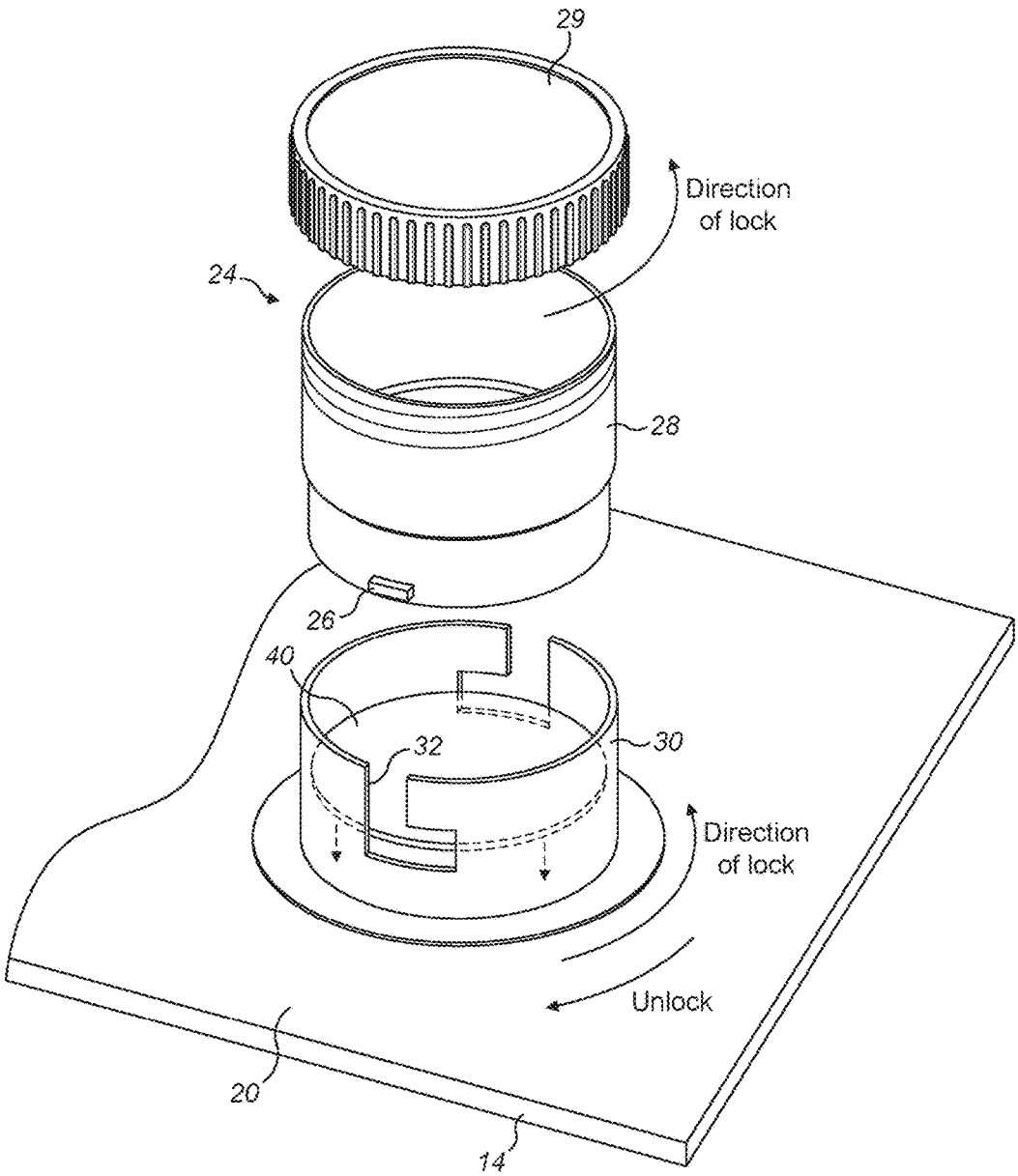
FIG. 5 is a perspective view of a container and the back cover of the book of FIG. 1.
Figure 6:
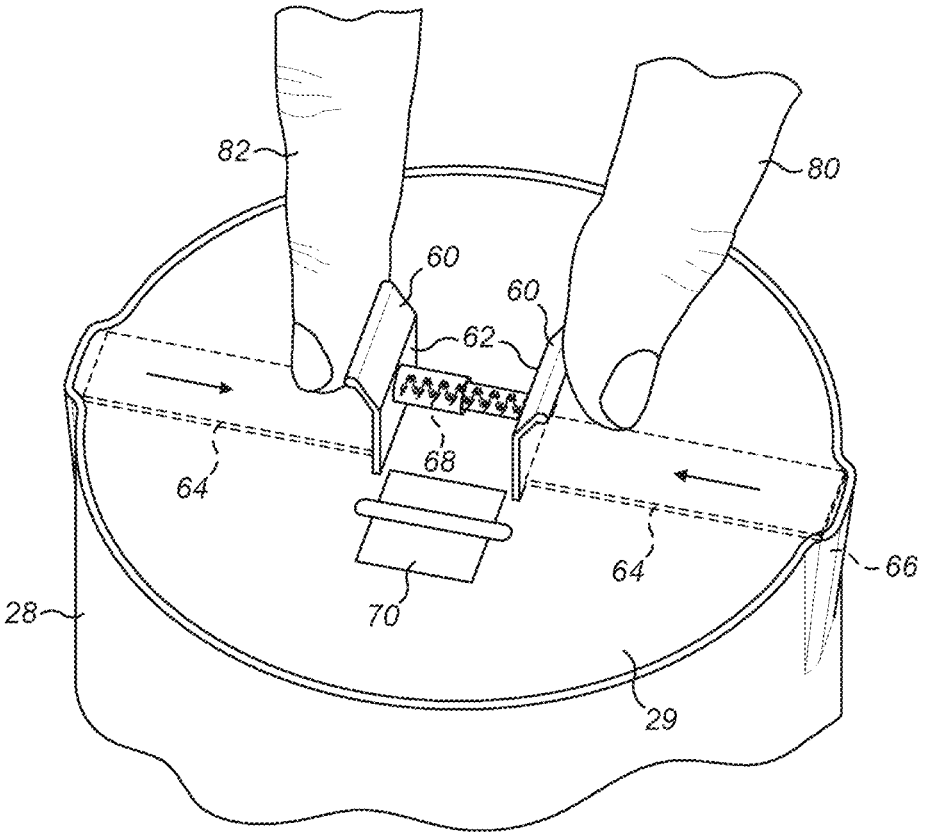
FIGS. 6 and 7 show perspective and sectional views, respectively, of a locking mechanism for a lid of the container shown in FIG. 5.
Figure 7:
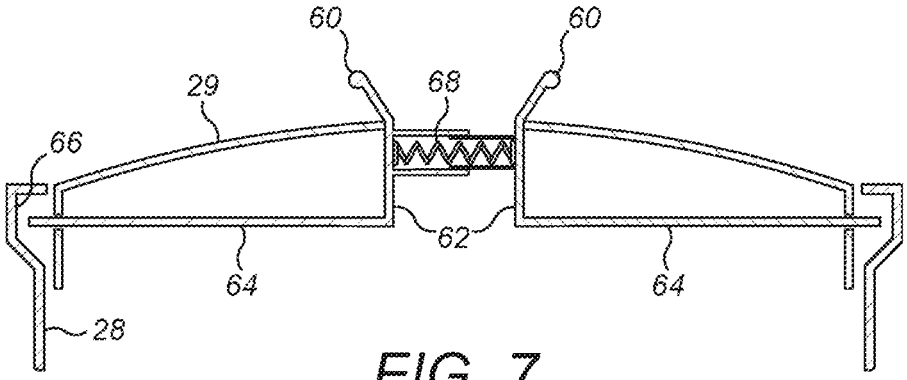

The lid 29 may have an internal screw thread which engages with a corresponding external thread adjacent the top of the body 28 such that the container has a screw-top lid. Such an arrangement is shown in FIG. 5. Alternatively, the lid 29 may be attached and detached from the container body 28 by a locking mechanism, an example of which is shown in FIGS. 2, 6 and 7.

In the illustrated embodiment, the locking mechanism comprises a pair of sliding actuators 60 which are slidably attached to the lid 29. Each actuator 60 has a first control portion 62 extending from an upper surface of the lid 29 and a second locking portion 64 which is attached to, or integrally formed with, the control portion 62 and extends substantially perpendicular to the control portion 62. The actuators 60 may be arranged so that the locking portions 64 are on the opposite side of the lid 29 from the control portions 62, or else the locking portions may be located within the lid itself.

The container body 28 includes a pair of locking recesses 66 which receive the locking portions 64 of the respective actuators 60 when they are in a locked position so as to lock the lid 29 to the body 28. An actuator biasing member in the form of compression spring 68 is located between the pair of actuators 60 such that opposite ends of the spring 68 press against the control portions 62 of the actuators and are therefore always forcing the actuators 60 outwards towards the locked position in substantially opposite directions. The spring 68 may be contained within a telescopic plastic housing.

The locking mechanism may also include a locking member 70 which can be selectively moved between locked and unlocked positions. As best seen in FIG. 6, the locking member 70 is provided on the upper side of the lid 29 and can slide on the lid in a direction substantially perpendicular to those followed of the actuators 60. The locking member 70 can hence be moved between a first position in which it is spaced from the actuators and a second position in which at least part of the locking member 70 lies between the actuators, the latter position being shown in FIG. 6. In the second, locked position the locking member 70 is located between the pair of actuators 60 and prevents movement of the actuators towards one another against the force of the spring 68. Thus, using a thumb 80 and forefinger 82 to pinch the control portions 62 of the actuators 60 together (as shown in FIG. 6) results in the unlocking of the lid 29 against the force of the spring 68. The lid 29 can then be opened or removed. Thus a small child can open the lid easily via the actuators 60 but the locking member 70 can be slid into the second position and acts as a safety lock to prevent the child from removing the lid 29 from the container when unsupervised.

Figure 8:
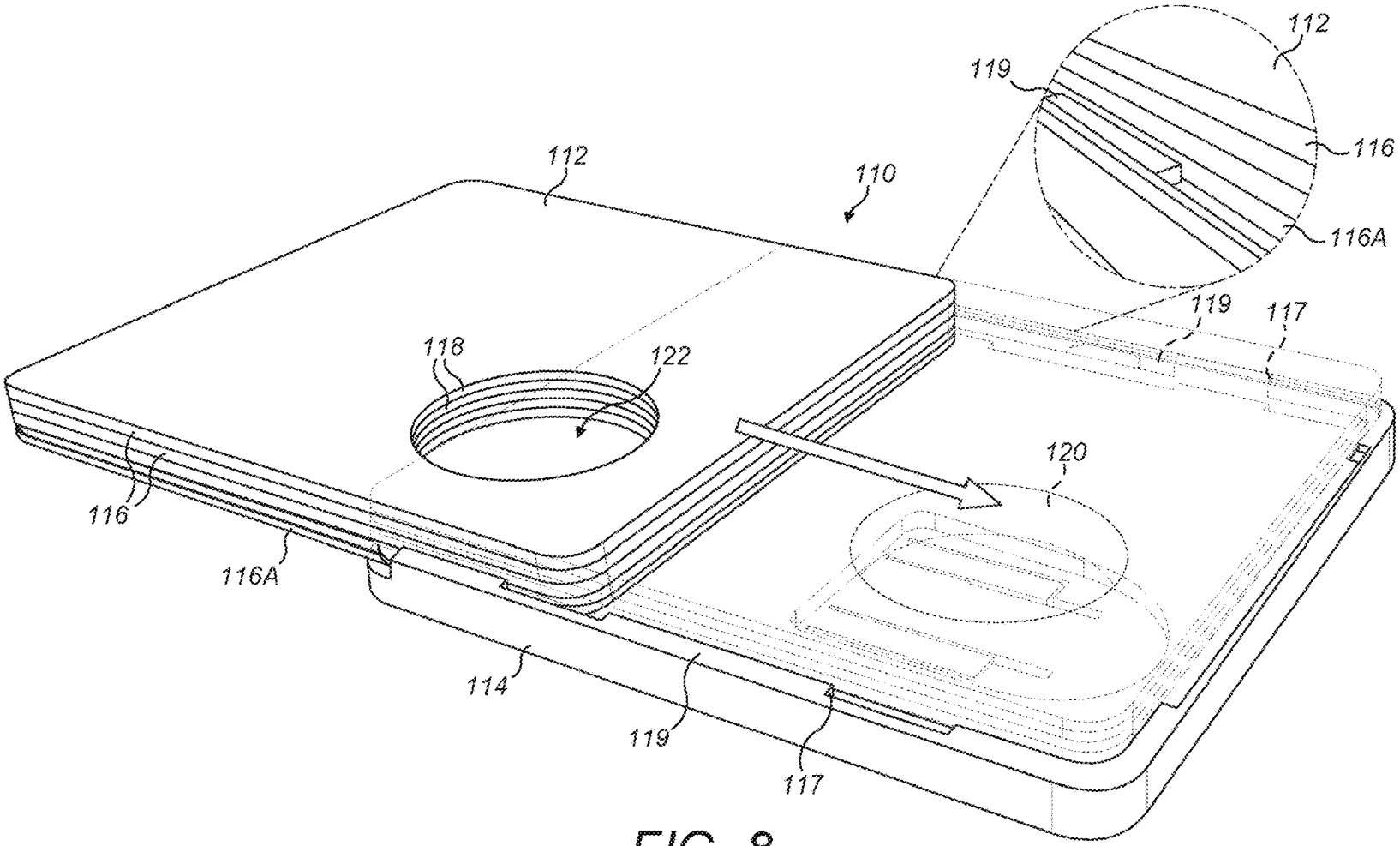
FIG. 8 is a perspective view of a second embodiment of an interactive book.

FIG. 8 shows a second, or alternative, embodiment of an interactive book in accordance with the present invention. The book 110 comprises a front cover 112, a back cover or base member 114, and a plurality of pages 116 bound to the front cover 112. The base member 114 is formed from a plastics material and is detachable from the front cover 112 and pages 116. As seen in FIG. 8, the base member 114 may include a plurality of peripheral grooves 117 which receive the outer edges of the bottom page 116A as the front cover 112 and pages 116 are slid into the base member 114. The grooves 117 may be at least partially defined by projecting lip members 119 which project inwardly from the periphery of the base member 114. The front cover 112 and pages 116 are preferably formed from a resilient material, such as plastic or relatively thick card as is the case in the illustrated example. As with the first embodiment the front cover 112 and pages 116 each have an aperture 118 cut therein at an identical location and when the book is closed the resulting plurality of apertures align and cooperate with an inside face 120 of the base member 114 to define a recess 122 extending through the book 110. The aperture 118 in the bottom page 116A may be larger than those of the other pages 116 and front cover 112 to assist in the attachment of a container to the base member 114 as will be described below.

Figure 9:
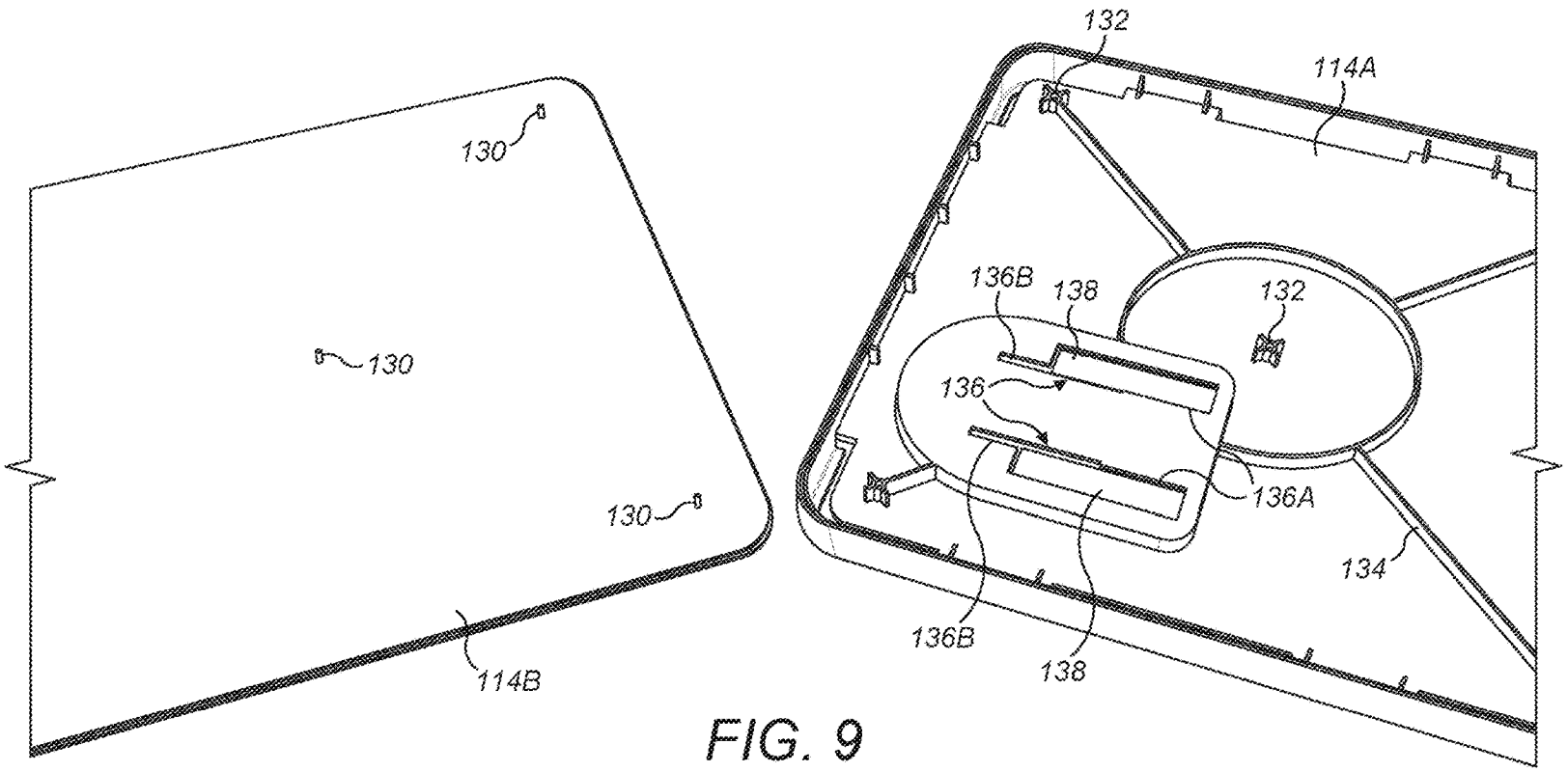
FIG. 9 is an exploded view of a base of the book shown in FIG. 8.

An exploded view of the base member 114 is shown in FIG. 9. The base member 114 is formed from two moulded plastic components in the shape of base plate 114A and fascia plate 114B. Fascia plate 114B includes a number of projecting pins 130 which during assembly locate in corresponding bosses 132 in the base plate 114A. The base plate 114A may also include a number of ribs 134 in order to limit the flexibility of the base member 114. The base plate 11A also includes a pair of substantially parallel slots 136. Each slot 136 includes a wide portion 136A and a narrow portion 136B. Located in the wide portion 136A of each slot 136 is a resilient flap or tongue 138 which is connected to the base plate 114A at or adjacent the end of the slot 136 which is remote from the narrow portion 136B. As a result, the flap 138 acts as a biasing spring which can be pressed down but which will then spring back to its rest position lying in substantially the same plane as the base plate 114A.

Figure 10:
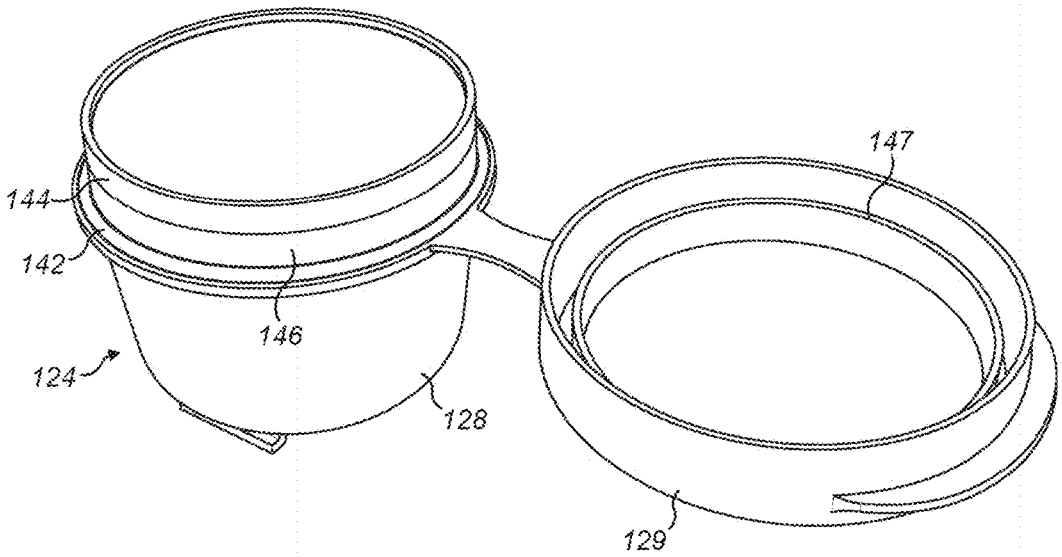
FIGS. 10 and 11 are perspective views of a container of the book of FIG. 8 shown in upright and inverted positions.
Figure 11:
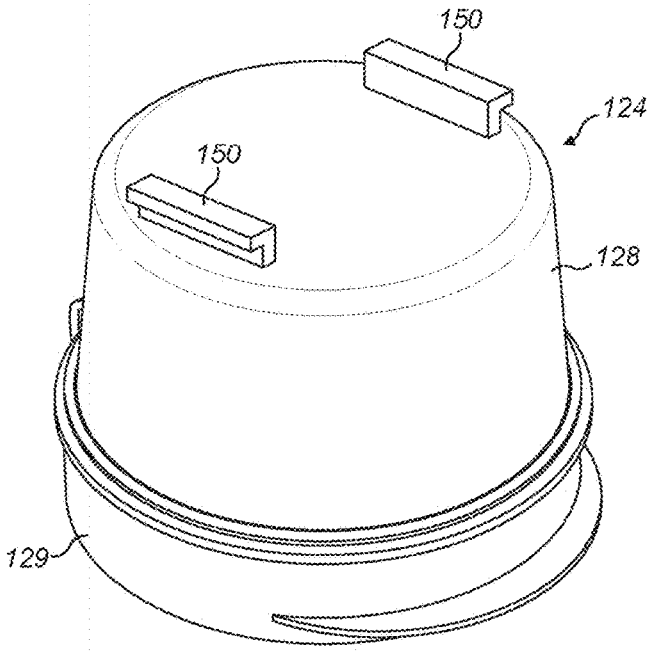

Referring now to FIGS. 10 and 11 the book 110 also includes a container 124 which is attached to the inside face 120 of the base plate 114A of the base member 114. The container 124 has a body 128 and a lid 129 which may be opened in order to access the interior of the container. As seen in FIG. 10, the lid 129 is preferably integrally formed with the body 128 so that the lid remains attached to the body even when the container 124 is open. A thermoplastic elastomer sealing member 142 locates in the open end 140 of the container body 128. The sealing member 142 may have first and second ridges 144,146 projecting radially outwards from the annular sealing member. The first, or uppermost, ridge 144 does not project outwardly as far as the second, or lower ridge 146. Thus, the lid 129 can be closed at one of two positions where an inner rim 147 of the lid 129 engages either the first or second ridge 144,146. In the former position the lid 129 may be opened relatively easily by a child. However, in the latter position where the inner rim 147 engages the lower ridge 146 which projects further the lid 129 cannot easily be opened without application of a comparatively large force by an adult. Thus, the two ridges 144,146 provide a child lock of sorts depending on which of the two ridges is engages by the lid inner rim 147.

As seen in FIG. 11, the container body 128 includes a pair of substantially parallel L-shaped runners 150 on the base thereof. In use, the leading edges of these runners 150 are pressed into the wide portions 136A of the slots 136 in the base plate 114A thereby pushing the flaps 138 downwards. The runners 150 are then slid along the slots 136 into the narrow portions 136B thereof. As the runners 150 enter the narrow portions 136B of the slots 136 the flaps 138 will return to their rest positions and thus lock the runners 150 and container 124 to the base plate 114A until sufficient downwards force is applied to slide the runners back out of the narrow portions 136B of the slots 136.

Hence the container 124 can be detachably secured to the base member 114 in the recess 122 of the book 110 in a similar manner to that of the first embodiment.

INDUSTRIAL APPLICABILITY

The present invention provides an interactive book in which additional objects or items which are used to enhance the content of the book are stored in a container attached to the book itself. In use, objects which are to be used in conjunction with the book are stored within the container so that they are not lost when the book is not in use. In the event that the items being stored may create a mess (e.g. foodstuff samples or paints) one embodiment of the invention allows for the detachment and cleaning of the container before it is reattached to the book. In the foodstuff application this detachable container may also be placed in a microwave oven to heat the items therein.

Where the items are not to be handled by a young child without supervision, one embodiment of the invention provides a childproof locking mechanism which ensures that the lid of the container cannot be removed by young hands.

Whilst the preferred embodiment provides a book in which the front cover and each and every page of the book includes an aperture for defining the recess, the invention is not limited to this specific arrangement. For example, only a limited number of the pages at the rear of the book may have an aperture, and the container is located in a recess defined by only those select pages. In such an arrangement the uppermost page of the book which has an aperture may include a flap which covers the aperture. In this way, the reader must lift the flap to gain access to the recess and the container located therein. In the arrangement where the front cover and all of the pages have apertures, the front cover could be provided with the aforementioned flap.

Whilst the preferred embodiment of the book employs a container which has both a body and removable lid, the present invention is not limited to this specific arrangement. For example, the container may simply comprise a container body which is open at the top. When the container is to be attached to the back cover of the book the book is inverted so that the inside face of the back cover is facing downwards, and the container is attached directly to the back cover. Thus, the back cover acts as the lid or closure of the container so that the contents cannot fall out once the container is attached.

The optional locking mechanism for the container lid is not limited to that described above. For example, it may consist of a single actuator, a corresponding single locking recess, and an actuator biasing member. As an alternative to the arrangement described the locking mechanism may instead be another suitable childproof arrangement such as, for example, a "push and twist" mechanism in which the lid must be pushed downwards and twisted in order to be removed from the container body.

The present invention is not limited to a book having a single recess and container located therein. Instead, the book may have a number of pages which each have a number of apertures located at the same positions on each page. Those sets of apertures then align when the book is closed so as to define a corresponding number of recesses. A corresponding number of containers can then be positioned in these recesses and each is attached to the back cover of the book in the manner described in the specific description above. Aside from the multiple recesses this book may have the same features as the single recess and container embodiment. Each of the containers may also have the same features as the container used in that embodiment.

These and other modifications and improvements may be incorporated without departing from the scope of the present invention.

The invention claimed is:

1. An interactive book comprising:

a front cover;

a back cover;

a plurality of pages bound between the front cover and the back cover;

wherein the plurality of the pages each have an aperture and the resulting plurality of apertures cooperate with the back cover to define a recess extending through the plurality of pages;

a container that completely encapsulates an object, the container being selectively attachable to the back cover and located in the recess when attached to the back cover; and wherein the front cover has formed therein an aperture that defines the recess along with the apertures in the pages such that the container is accessible when the front cover is closed.

2. The interactive book of claim 1, wherein the front cover comprises a flap which covers the front cover aperture.

3. The interactive book of claim 1, wherein the container comprises a body, a lid, and a locking mechanism for locking the lid in a closed position on the body.

4. The interactive book of claim 3, wherein the locking mechanism comprises at least one actuator slidably attached to one of the lid and body, at least one locking recess on the other of the lid and body for receiving at least a portion of the at least one actuator, and an actuator biasing member which biases the at least one actuator towards the at least one locking recess.

5. The interactive book of claim 4, wherein the locking mechanism comprises a locking member which can be selectively moved between locked and unlocked positions, wherein in the locked position the locking member prevents movement of the at least one actuator against the force of the actuator biasing member.

6. The interactive book of claim 3, wherein the locking mechanism comprises a pair of actuators slidably attached to the lid, and a pair of locking recesses on the body, wherein the actuator biasing member is located between the pair of actuators so as to bias the actuators in substantially opposite directions towards their respective locking recesses.

7. The interactive book of claim 6, wherein the locking mechanism further comprises a locking member which can be selectively moved between locked and unlocked positions, wherein in the locked position the locking member is located between the pair of actuators so as to prevent movement of both actuators against the force of the actuator biasing member.

8. The interactive book of claim 1, wherein the container comprises a body having an open end, a lid having an inner rim, and a seal member which is located adjacent the open end of the body so as to selectively engage the inner rim of the lid and close the container, wherein the seal member comprises first and second ridges which project radially outwards from the seal member, the first ridge is closer to the open end than the second ridge, and the second ridge projects a greater radial distance than the first ridge.

9. The interactive book of claim 1, wherein the container is removably attached to the back cover.

10. The interactive book of claim 9, wherein the back cover comprises at least one attachment member which receives a portion of the container so as to selectively attach the container to the back cover.

11. The interactive book of claim 9, wherein the at least one attachment member is resilient so as to selectively clamp a portion of the container to the back cover.

12. The interactive book of claim 10, wherein the container comprises a plurality of outwardly extending lugs, and the attachment member includes a corresponding plurality of L-shaped channels for receiving the lugs.

13. The interactive book of claim 12, comprising at least one container biasing member having a first end attached to the back cover so as to bias the container away from the back cover when the container is present.

14. The interactive book of claim 12, wherein the attachment member comprises a corresponding plurality of L-shaped channels for receiving the lugs.

15. The interactive book of claim 13, comprising a base plate for receiving a base of the container, wherein a second end of the at least one container biasing member is attached to the base plate so as to bias the base plate and container away from the back cover.

* * * * *